US007466949B2

(12) United States Patent
Satoh et al.

(10) Patent No.: US 7,466,949 B2
(45) Date of Patent: Dec. 16, 2008

(54) FIXING DEVICE HAVING A SEPARATION PLATE

(75) Inventors: Masahiko Satoh, Chiba (JP); Naoki Iwaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 10/586,399

(22) PCT Filed: Nov. 17, 2005

(86) PCT No.: PCT/JP2005/021494

§ 371 (c)(1),
(2), (4) Date: Jul. 17, 2006

(87) PCT Pub. No.: WO2006/059518

PCT Pub. Date: Jun. 8, 2006

(65) Prior Publication Data

US 2007/0166083 A1 Jul. 19, 2007

(30) Foreign Application Priority Data

Nov. 30, 2004 (JP) ..... 2004-347677

(51) Int. Cl.
*G03G 15/20* (2006.01)

(52) U.S. Cl. ..... 399/323; 271/900

(58) Field of Classification Search ..... 399/323, 399/322, 67, 398, 399; 219/216; 271/311, 271/312, 307, 900
See application file for complete search history.

(56) References Cited

U.S. PATENT DOCUMENTS

| | | | | |
|---|---|---|---|---|
| 4,821,064 | A * | 4/1989 | Mills et al. | 399/323 |
| 5,241,354 | A * | 8/1993 | Flynn | 399/323 |
| 5,517,292 | A * | 5/1996 | Yajima et al. | 399/323 |
| 5,532,810 | A * | 7/1996 | Cahill | 399/323 |
| 6,236,829 | B1 * | 5/2001 | Uehara et al. | 399/323 |
| 6,661,994 | B2 * | 12/2003 | Ohuchi et al. | 399/323 X |
| 6,795,676 | B2 * | 9/2004 | Kikuchi et al. | 399/323 |
| 6,882,820 | B2 | 4/2005 | Shinshi et al. | 399/328 |
| 2002/0071699 | A1 * | 6/2002 | Baughman et al. | 399/323 |
| 2004/0151521 | A1 * | 8/2004 | Rasch et al. | 399/323 |
| 2004/0170454 | A1 * | 9/2004 | Gomi et al. | 399/323 |
| 2005/0008408 | A1 * | 1/2005 | Inomata | 399/323 |
| 2005/0129432 | A1 | 6/2005 | Sato et al. | 399/329 |
| 2005/0163543 | A1 | 7/2005 | Satoh et al. | 399/329 |

FOREIGN PATENT DOCUMENTS

| | | |
|---|---|---|
| JP | 06 043772 | 2/1994 |

(Continued)

*Primary Examiner*—Sophia S Chen
(74) *Attorney, Agent, or Firm*—Oblon, Spivak, McClelland, Maier & Neustadt, P.C.

(57) ABSTRACT

A fixing device includes i) two surface moving bodies, at least one of which is driven so that the surface moving bodies come in contact with each other and a nip is formed and ii) a heat source configured to heat at least one of the surface moving bodies. A transfer medium is put in the nip so that the toner image is heat-fixed on the transfer medium. A separation plate is provided and is configured to remove the transfer medium. Rise of temperature of a head end part, at a side of the surface moving body, of the separation plate is given priority over rise of temperature of other parts of the separation plate.

9 Claims, 7 Drawing Sheets

FOREIGN PATENT DOCUMENTS

| | | | | |
|---|---|---|---|---|
| JP | 06 274057 | | | 9/1994 |
| JP | 07 315623 | | | 12/1995 |
| JP | 09-114303 | A | * | 5/1997 |
| JP | 10-074014 | A | * | 3/1998 |
| JP | 2000 089594 | | | 3/2000 |
| JP | 2000 231293 | | | 8/2000 |
| JP | 2001-215841 | A | * | 8/2001 |
| JP | 2003 107947 | | | 4/2003 |
| JP | 2003-122173 | A | * | 4/2003 |
| JP | 2003/202767 | | | 7/2003 |
| JP | 2004-205748 | | | 7/2004 |
| JP | 2004-205749 | A | * | 7/2004 |
| JP | 2005-077515 | A | * | 3/2005 |

* cited by examiner (a)

(b)

FIXING DEVICE HAVING A SEPARATION PLATE

TECHNICAL FIELD

The present invention relates to fixing devices and image forming apparatuses using the same.

BACKGROUND ART

In a conventional image forming apparatus, a latent image on an image carrier is developed by a toner supplied from a developing device so that a toner image is formed on the image carrier as a visual image. The toner image on the image carrier is transferred onto a transfer medium by a transferring device so as to be fixed on the transfer medium by a fixing device. The fixing device, for example, includes a heater, a fixing roller, and a pressure roller. The heater is provided inside of the fixing device as a heating source. The fixing roller works as a rotatable surface moving body. The pressure roller comes in contact with a surface of the fixing roller at a designated pressure and works as another rotatable surface moving body. The fixing roller and the pressure roller form a nip part. The toner image is fixed on the transfer medium by heat and pressure applied by using the nip part. The transfer medium where the toner image is fixed by the nip part is discharged via discharge path. On the other hand, a transfer medium not separated from the fixing roller or the pressure roller after passing through the nip part due to stiffness of a paper sheet or curvature of the fixing roller or the pressure roller is forcibly separated from the fixing roller or the pressure roller by a separation plate whose head end part is provided in the vicinity of the nip part so as to be discharged.

Generally, the transfer medium contains moisture. The moisture contained in the transfer medium is changed to vapor by heating the transfer medium by the nip part so as to be discharged from the transfer medium. The vapor discharged from the transfer medium is changed to condensation if coming in contact with a separation plate having a low temperature. Since the head end of the separation plate is provided in the vicinity of the nip part, the possibility of the head end part coming in contact with the transfer medium is higher than the probability of other parts of the separation plate coming in contact with the transfer medium. Because of this, if the condensation is generated at the head end part of the separation plate, the transfer medium may become adhered to the head end part of the separation plate so that a paper jam may be generated.

There are several suggestions to solve such a problem of condensation.

For example, a fixing device having a structure where a notch part is provided at a head end part of a separation plate so as to let vapor generated from a transfer medium go out is suggested in Japan Laid-Open Patent Application No. 2003-202767. Because of such a notch part for letting let vapor generated from the transfer medium go out, the condensation is prevented from being adhered at the head end part of the separation plate. However, in the fixing device discussed in Japan Laid-Open Patent Application No. 2003-202767, if vapor not discharged from the notch part for letting the vapor generated from the transfer medium go out is adhered at the head end part of the separation plate, condensation is generated at the head end part of the separation plate.

A fixing device having a structure where a separation plate is made of thin metal having low specific heat or a material having high heat conductivity, the separation plate is heated by contact of the transfer medium which is heated at high temperature, and the temperature of the separation plate rises to a temperature at which condensation is not generated, is suggested in Japan Laid-Open Patent Application No. 6-43772. In this fixing device, the condensation is prevented from being adhered at the head end part of the separation plate by heating the separation plate.

However, in the fixing device discussed in Japan Laid-Open Patent Application No. 6-43772, it takes a lot of time for the temperature of the head end part of the separation plate to rise to a temperature at which condensation is not generated. Hence, until the temperature of the head end part rises to the temperature at which condensation is not generated, the condensation is adhered to the head end part of the separation plate. Particularly, in a state where the fixing device is left as it is for a long time so that the fixing device is cooled, the temperature of the separation plate is low. Hence, in this case, even if the transfer medium heated at high temperature comes in contact with the separation plate, the temperature of the head end part may not have risen to the temperature at which condensation is not generated so that the condensation may be adhered to the head end part of the separation plate.

In addition, in the fixing device discussed in Japan Laid-Open Patent Application No. 6-43772, since the temperature of the entire separation plate rises evenly due to the heat of the transfer medium, it takes a lot of time for the temperature of the head end part of the separation plate to rise by the heat of the transfer medium to a temperature at which condensation is not generated.

DISCLOSURE OF THE INVENTION

Accordingly, in a preferred embodiment of the present invention there is provided a novel and useful fixing device and image forming apparatus using the same.

According to one aspect of the present invention there is provided a fixing device and image forming apparatus whereby a temperature of a head end part at a side of a surface moving body of a separation plate can immediately rise to a temperature at which condensation is not generated.

An embodiment of the present invention is achieved by a fixing device, including:

two surface moving bodies, at least one of which is driven so that the surface moving bodies come in contact with each other, a nip is formed, and surfaces of the surface moving bodies in contact move in the same direction; and a heat source configured to heat at least one of the surface moving bodies;

wherein a transfer medium having a surface where a non-fixed toner image is formed is put in the nip so that the toner image is heat-fixed on the transfer medium;

the fixing device further comprises a separation plate configured to remove the transfer medium, the transfer medium not being separated from the surface moving body after the transfer medium passes through the nip, from the surface moving body; and rise of temperature of a head end part, at a side of the surface moving body, of the separation plate is given priority over rise of temperature of other parts of the separation plate.

An embodiment of the present invention is also achieved by an image forming apparatus, including:

a toner image forming part configured to form a toner image on a transfer medium; and a fixing part configured to fix the toner image to the transfer medium;

wherein the fixing part including:

two surface moving bodies, at least one of which is driven so that the surface moving bodies come in contact with each other, a nip is formed, and surfaces of the surface moving bodies in contact move in the same direction; and a heat source configured to heat at least one of the surface moving bodies;

wherein a transfer medium having a surface where a non-fixed toner image is formed is put in the nip so that the toner image is heat-fixed on the transfer medium;

the fixing device further comprises a separation plate configured to remove the transfer medium, the transfer medium not being separated from the surface moving body after the transfer medium passes through the nip, from the surface moving body; and rise of temperature of a head end part, at a side of the surface moving body, of the separation plate is given priority over rise of temperature of other parts of the separation plate.

According to the above-mentioned embodiments, a temperature of the head end part at the side of the surface moving body of the separation plate rises due to heat of the transfer medium heated at a high temperature where priority for being heated is given to the head end part at the side of the surface moving body of the separation plate more than other part of the separation plate. Because of this, the temperature of the head end part at the side of the surface moving body of the separation plate can rise by the transfer medium being heated at a high temperature to the temperature at which condensation is not generated more immediately than the conventional separation plate whose temperature rises evenly. As a result of this, even where the device is left for a long time as it is so that the separation plate is cooled, it is possible to immediately raise the temperature of the head end part at the side of the surface moving body of the separation plate to the temperature at which condensation is not generated, so that the generation of a paper jam can be prevented.

Other objects, features, and advantages of the present invention will become more apparent from the following detailed description when read in conjunction with the accompanying drawings.

BEST MODE FOR CARRYING OUT THE INVENTION

A description of the present invention and details of drawbacks of the related art are now given, with reference to FIG. 1 through FIG. 10, including embodiments of the present invention.

Figure 1:
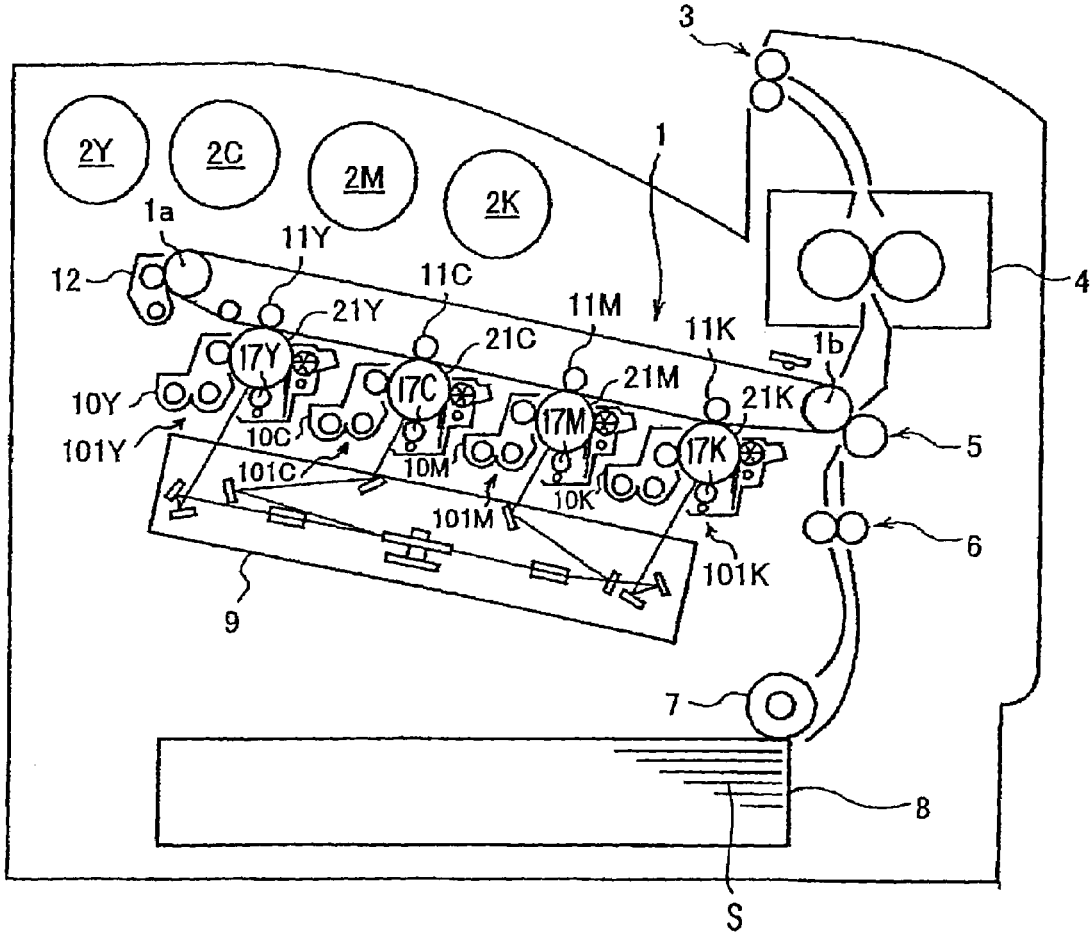
FIG. 1 is a schematic view of a printer of an embodiment of the present invention.

More specifically, a color laser printer (hereinafter "printer") is discussed as an example of the image forming apparatus of the present invention. FIG. 1 is a schematic view of the printer of an embodiment of the present invention. In this printer, four image forming parts for four colors yellow, magenta, cyan, and black are arranged horizontally so as to form a tandem image forming part. In the tandem image forming part, image forming parts, namely toner image forming parts 101Y, 101C, 101M and 101K, are arranged in turn from a left side of FIG. 1. Here, Y, M, C and K represent members for colors of yellow, magenta, cyan, and black, respectively. In the tandem image forming part, the image forming parts 101Y, 101C, 101M and 101K have structures where charging devices, developing devices 10Y, 10C, 10M and 10K, photosensitive body cleaning devices, and others are provided around drum-shaped photosensitive bodies 21Y, 21C, 21M and 21K, respectively. Toner bottles 2Y, 2C, 2M and 2K are arranged at an upper part of the printer. Toners of yellow, magenta, cyan, and black colors are supplied in the toner bottles 2Y, 2C, 2M and 2K, respectively. A designated amount of the toner of each color is supplied from the corresponding toner bottles 2Y, 2C, 2M and 2K to developing devices 10Y, 10C, 10M and 10K, respectively, via a conveyance part (not shown).

An optical writing unit 9 as a latent image forming part is provided at a lower part of the tandem image forming part. The optical writing unit 9 includes a light source, a polygon mirror, a f-θ lens, a reflection mirror, and others. The optical writing unit 9 scans and irradiates a laser light on a surface of each of the photosensitive bodies 21 based on the image data.

An intermediate transfer endless belt 1 as an intermediate transfer body is provided right above the tandem image forming part. The intermediate transfer belt 1 is wound around and tensioned by support rollers 1*a* and 1*b*. A driving motor (not shown in FIG. 1) as a driving source is connected to a rotational shaft of the support roller 1*a* functioning as a driving roller. As the driving motor is driven, the intermediate transfer belt 1 revolves in the counter-clockwise direction in FIG. 1 so that the dependent support roller 1*b* revolves. Primary transfer devices 11Y, 11C. 11M and 11K are provided inside of the intermediate transfer belt 1 so as to transfer the toner image formed on the photosensitive bodies 21Y, 21C 21M and 21K onto the intermediate transfer belt 1.

A secondary transfer roller 5 as a secondary transfer device is provided at a more downstream position in a driving direction of the intermediate transfer belt 1 than the primary transfer devices 11Y, 11C, 11M and 11K. The intermediate transfer belt 1 is put between the support roller 1*b* and the secondary transfer roller 5 and the support roller 1*b* works as a pushing member. The printer also has a paper feeding cassette 8, a paper feeding roller 7, resist rollers 6, and others. In addition, a fixing device 4 configured to fix an image on the transfer medium S and a paper discharge roller 3 are provided at a downstream side of the secondary transfer roller 5 in a moving direction of a transfer medium S onto which a toner image is transferred by the secondary transfer roller 5.

Next, an action of the printer is discussed. Photosensitive bodies 21Y, 21C, 21M, and 21K are rotated by the image forming parts and surfaces of the photosensitive bodies 21Y, 21C, 21M, and 21K are charged by charging devices 17Y, 17C, 17M and 17K, respectively. Then, laser writing light containing image data is irradiated on from the optical writing unit 9 so that electrostatic latent images are formed on the photosensitive bodies 21Y, 21C, 21M, and 21K. After that, corresponding toners are adhered by the developing devices 10Y, 10C, 10M, and 10K and the electrostatic latent images are made visible. As a result of this, single color images of yellow, cyan, magenta, and black are formed on the photosensitive bodies 21Y, 21C, 21M, and 21K, respectively. The driving roller 1*a* revolves due to the rotation of the driving motor (not shown in FIG. 1) so that the dependent roller 1*b* and the secondary transfer roller 5 revolve dependently so that the intermediate transfer belt 1 is rotated and conveyed. The visible images are transferred onto the intermediate transfer belt 1 in turn by the primary transfer devices 11Y, 11*c*, 11M and 11K. As a result of this, a synthetic color image is formed on the intermediate transfer belt 1. Residual toner is removed from the surfaces of the photosensitive bodies 21Y, 21C, 21M and 21K from which the images are transferred by a cleaning device so that the photosensitive bodies 21Y, 21C, 21M and 21K are prepared for the next image forming.

In timing with image forming, a head end of the transfer medium S is taken out from the paper feeding cassette 8 by the paper feeding roller 7 so that the transfer paper S is conveyed to the resist roller 6 and stopped for a while.

In timing with the image forming operation, the transfer medium S is conveyed between the secondary transfer roller 5 and the intermediate transfer belt 1. The transfer medium S is put between the secondary transfer roller 5 and the intermediate transfer belt 1 so that the secondary transfer roller 5 and the intermediate transfer belt 1 form a secondary transfer nip. The toner image on the intermediate transfer belt 1 is transferred (second transfer) onto the transfer medium S by the secondary transfer roller 5

The transfer medium S to which the image is transferred is sent to the fixing device 4. Heat and pressure are applied to the transfer medium S by the fixing device 4 so that the transfer image is fixed to the transfer medium S. After that, the transfer medium S is discharged outside of the image forming apparatus. On the other hand, the residual toner remaining on the intermediate transfer belt 11 after the image is transferred is removed by an intermediate transfer body cleaning device 12 so that the image forming machine is prepared for the next image forming by the tandem image forming part.

Toner image forming parts 101Y, 101C, 101M and 101K are formed in a body and function as process cartridges detachable from the main body of the printer. The process cartridge can be pulled out to a front side of the main body of the printer along a guide rail. By pushing the process cartridge to a deep side of the main body of the printer, the toner image forming part can be provided in a designated position.

Figure 2:
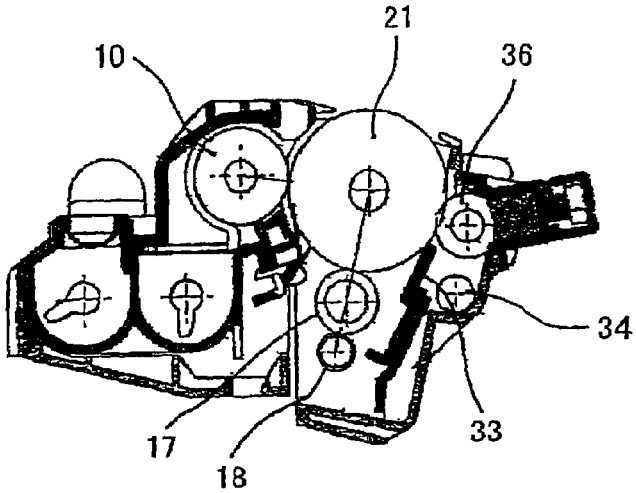
FIG. 2 is a schematic view of a process cartridge forming a toner image forming part of the printer shown in FIG. 1.

The process cartridges of the toner image forming parts 101Y, 101C, 101M and 101K have same structures and perform the same actions. In the following explanations, indications Y, C, M and K are omitted and details of the process cartridge of the toner image forming part are discussed. FIG. 2 is a schematic view of a process cartridge of a toner image forming part 101 of the printer shown in FIG. 1. As shown in FIG. 2, a charging roller 17 as a charging device, a developing device 10, a fur brush 36 as a photosensitive body cleaning device, a cleaning blade 33 and others are arranged around the photosensitive body 21 rotating in a clockwise direction. Thus, in the printer of this embodiment, the charging roller 17 is arranged below the photosensitive body 21 in a vertical direction. Furthermore, a cleaner roller 18 as a charging cleaning roller is provided below the charging roller 17. The cleaner roller 18 rotatably comes in contact with and cleans the surface of the charging roller 17. In addition, the photosensitive cleaning device includes the fur brush 36, the cleaning blade 33, and waste toner conveyance coil 34 for discharging a waste toner removed from the photosensitive body 21 to the outside of the process cartridge.

Figure 3:
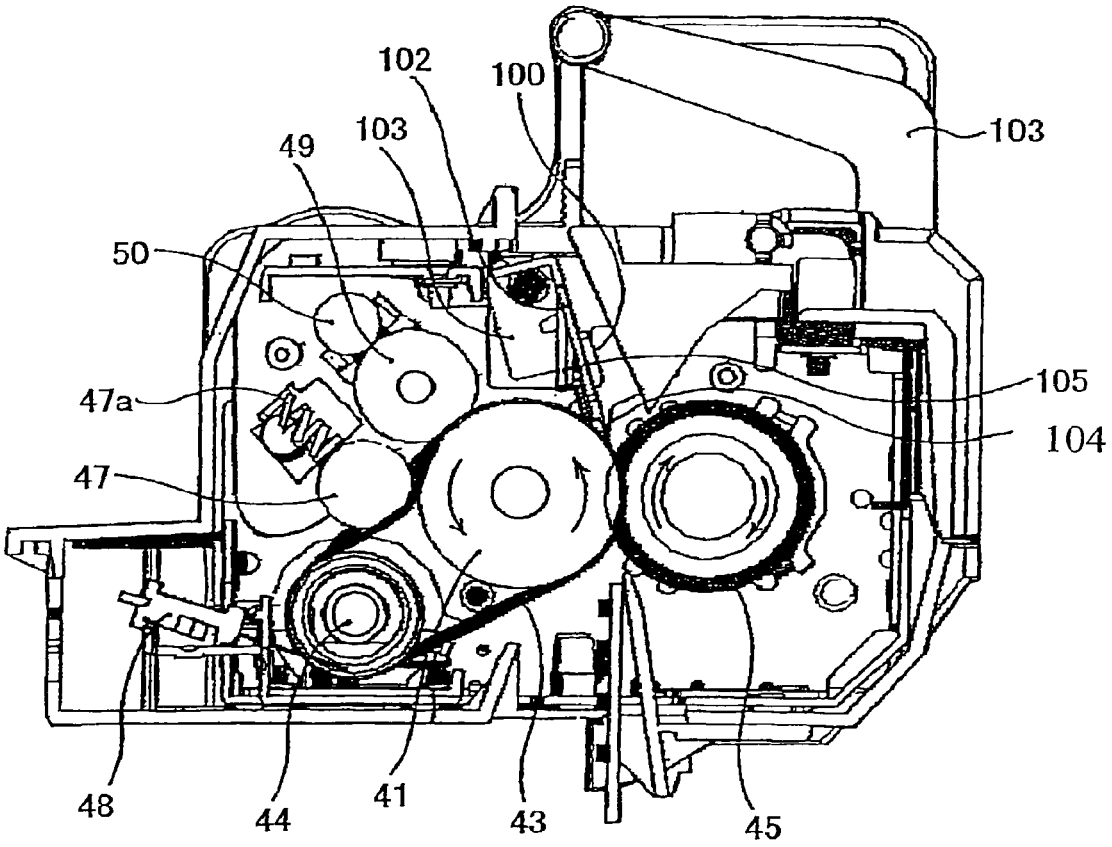
FIG. 3 is a schematic view of a fixing device.
Figure 4:
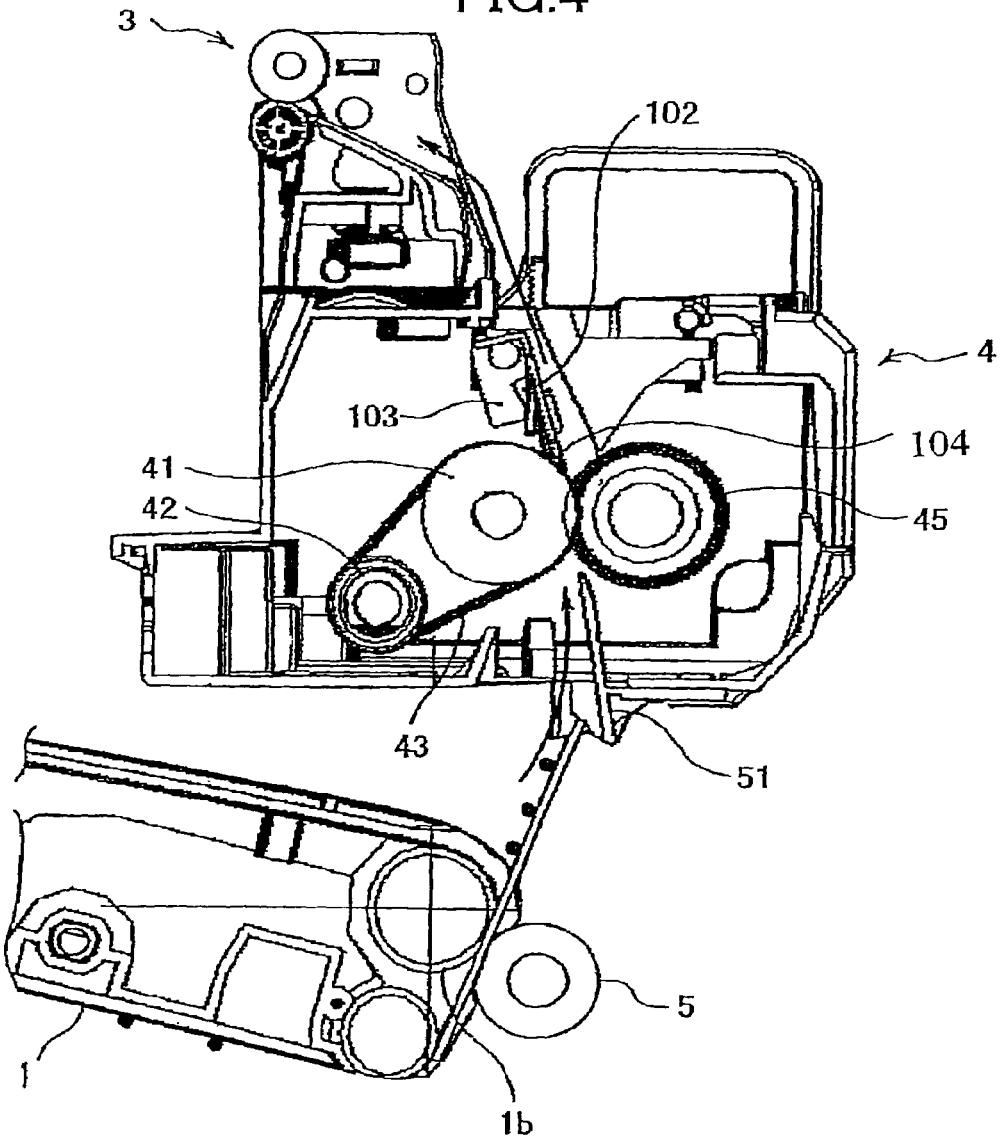
FIG. 4 is a schematic view showing a conveyance part of a transfer medium before and after the fixing device.

FIG. 3 is a schematic view of a fixing device 4. As shown in FIG. 4, the fixing device 4 has a structure where an endless fixing belt 43 as a surface moving body is wound around a heating roller 42 and a fixing roller 41.

A rear surface of the fixing belt 43 is heated so that the temperature of the fixing belt 43 rises to be in the range of 140 through 180° C. Hence, it is preferable to use a material having heating resistance (low heat conductivity) and durability for the fixing belt. The fixing belt 43 has a multilayer structure where an elastic layer is formed on a cylindrical-shaped film base made of heat resistant resin such as polyimide and a release layer is formed on the elastic layer. The base may be made of material having heat resistance and good mechanical strength. The film base may be made of metal such as Ni or SUS in addition to the heat resistant resin such as polyimide. In order to obtain a stable fixing property, the elastic layer of the fixing belt 43 may be made of material by which heat and pressure are given to the toner and the transfer medium. For example, a silicon rubber or fluoride rubber may be used for the elastic layer of the fixing belt 43. The release layer of the fixing belt 43 is provided in order to prevent a partial offset of the toner image formed on the transfer medium. Hence, it is preferable to use a material having good toner releasability as a material for the release layer of the fixing belt 43. For example, as the material for the release layer of the fixing belt 43, fluoride resin such as polytetrafluoroethylene (PTFE), copolymer of tetrafluoroethylene and perfluoroalkoxyethylene (PFA), fluorinated-ethylene-propylene (FEP) or material made by blending these materials may be used. The release layer made of such a material can be obtained by applying the material on the elastic layer via a primer and baking.

The base of the fixing belt 43 of this embodiment has a thickness of approximately 50 through 90 μm. The elastic layer of the fixing belt 43 of this embodiment has a thickness of approximately 100 through 300 μm. The release layer of the fixing belt 43 of this embodiment has a thickness of approximately 20 through 50 μm.

In the heating roller 42, a heating source 44 such as a halogen lamp is installed in a cored bar made of metal such as aluminum or iron. The inside of the fixing belt 43 is heated by radiant heat of the heating source 44. It is preferable that the cored bar of the heating roller 42 have a small thickness. However, since the cored bar receives tension of the fixing belt 43, it is necessary for the cored bar of the heating roller 42 to have a thickness equal to or greater than 0.4 mm if the cored bar is made of aluminum. Furthermore, it is necessary for the cored bar of the heating roller 42 to have a thickness equal to or greater than 0.2 mm if the cored bar is made of iron. In addition, a color such as black whereby heat from the heating source 44 may be easily absorbed is applied on the inside of the cored bar.

In addition, a thermistor 48 is arranged at the heating roller 42 as a temperature sensor element. Based on the temperature detection of the thermistor 48, the heating part 44 is controlled so as to have a setting temperature.

The fixing roller 41 has a structure where an elastic layer such as silicon rubber is formed on a cored bar having high rigidity such as metal, for example, aluminum or iron, or resin having high strength. It is most preferable to use a sponge rubber as a material for the elastic layer of the fixing roller 41. It is possible to make the elastic layer have a low hardness equal to or less than 50 HS (Asker C) by using the sponge rubber so that addition of the fixing belt can be made small. In addition, since the sponge rubber has lower heat conductivity than a normal rubber, it can be difficult to let heat of the fixing belt go out.

A tension roller 47 is provided in an intermediate position between the fixing roller 41 and the heating roller 42. The tension roller 47 comes in contact with the fixing belt 43. The tension roller 47 presses the fixing belt 43 inside by the spring force of a spring 47*a*. Thus, tension is given to the fixing belt 43. The tension roller 47 has a structure where a cored bar made of material having high rigidity such as metal is covered with a material having a certain degree of elasticity such as heat resistant felt or silicon rubber. By covering the cored bar with the heat resistant felt or silicon rubber, it is possible to prevent the fixing belt 43 from being damaged at the time of pressing the fixing belt 43 so that a uniform pushing pressure can be easily secured. In addition, as compared with the tension roller having only the cored bar, the heat conductivity of the tension roller 47 can be relatively reduced. Therefore, it is possible to prevent the heat of the fixing belt 43 from being radiated from the tension roller 47. In this embodiment, the tension roller 47 comes in contact with an external circumferential surface of the fixing belt 43 so that the fixing belt 43 is pushed to the inside; thereby, tension is given to the fixing belt 43. However, the present invention is not limited to this example. For example, the tension roller 47 may come in contact with an internal circumferential surface of the fixing belt 43 so that the fixing belt 43 may be pushed to the outside; thereby, tension may be given to the fixing belt 43. Furthermore, the fixing roller 41 or the heating roller may function as a tension roller. In this case, the fixing belt 43 is pushed to the outside by the fixing roller 41 or the heating roller 42 which can be moved so that tension is given to the fixing belt 43.

In addition, the fixing device 4 includes a pressing roller 45 as another surface moving body. The pressing roller 45 presses the fixing roller 41 via the fixing belt 43 by an energizing part such as a spring (not shown in FIG. 3) so that a fixing nip is formed. The pressing roller 45 has a structure where an elastic layer made of silicon rubber is formed on a cored bar having rigidity made of, for example, metal. The elastic layer may be covered with a member having good releasability such as a PFA tube. The hardness of the pressing roller 45 is made greater than the hardness of the fixing roller 41 by making the hardness of the rubber high or making the thickness of the elastic layer small. If the hardness of the pressing roller 45 is greater than the hardness of the fixing roller 41, the fixing roller 41 surface becomes sunken so that the fixing nip is curved (concave on the pressing roller 45 side) along the axial directions of the pressing roller 45. The fixing device 4 of this embodiment has a structure where an image on a surface at a fixing belt side of the transfer medium is fixed. The toner heated and made molten by the fixing nip is adhered to the fixing belt 43 and the transfer medium is easily adhered to the fixing belt 43. However, since the fixing nip is curved along the axial directions of the pressing roller 45, the transfer medium conveyed by the fixing nip is curved along the axial directions of the pressing roller 45. Because of this, since the transfer medium moves along the pressing roller 45 at a fixing nip exit, the transfer medium together with the toner may be easily released from the fixing belt 43. Particularly, since a color image has a greater amount of the toner on the transfer medium than a black and white image, the color image is easily adhered to the fixing belt. However, as discussed above, by making the hardness of the pressing roller 45 greater than the hardness of the fixing roller 41, even in the case of the color image, it is difficult for the transfer medium to be adhered to the fixing belt 43.

The pressing roller 45 is rotated by a driving part (not shown) so that the fixing roller 41 is dependently rotated. While the driving part is provided to drive the pressing roller 45 in this embodiment, the driving part may be provided to drive the fixing roller 41 so that the pressing roller 45 is dependently rotated.

A release agent applying roller 49 is provided in the fixing device 4 so that the molten toner is prevented from being adhered to the fixing belt 43. The release agent applying roller 49 presses the fixing belt 43 so as to be rotated with the fixing belt 43, and thereby the release agent is supplied to the fixing belt 43. The release agent applying roller 49 is made of material having permeability such as sponge. The inside of the release agent applying roller 49 is filled with silicon oil, for example, as the release agent. A cleaning roller 50 is provided so as to press the release agent applying roller 49 and remove paper powder or the like adhered to the release agent applying roller 49. A surface of the cleaning roller 50 has a brush-shaped configuration, for example. The cleaning roller 50 is rotated with the release agent applying roller 49. The brush may be made of a material having conductivity so that the paper powder adhered to the release agent applying roller 49 is removed electrostatically.

A separation plate 100 having a head end part 104 is provided at a downstream side in a paper conveyance direction of the fixing nip and thereby the paper is prevented from being wound around the fixing belt 43. A detailed structure of the separation plate 100 is discussed below. A head end of the head end part 104 does not come in contact with the fixing belt 43. A gap having a length equal to or less than 1 mm is formed between the head end of the head end part 104 and the fixing belt 43. In a case where the head end of the head end part 104 comes in contact with the fixing belt 43, the fixing belt 43 may be damaged by the head end of the head end part 104. In a case where the gap between the head end of the head end part 104 and the fixing belt 43 is greater than 1 mm, the transfer medium discharged from the fixing nip is caught between the head end of the head end part 104 and the fixing belt 43 so that paper jam may happen. Furthermore, the longer the time duration that the transfer medium is adhered to the fixing belt 43 is, the more unevenness of the image may be easily generated. Hence, it is preferable that the transfer medium be separated from the fixing belt 43 by the head end of the head end part 104 as soon as the transfer medium is out from the fixing nip. Because of this, it is preferable that the head end of the head end part 104 be closer to the fixing nip.

Next, a conveyance path of the transfer medium before and after the fixing device is discussed. FIG. 4 is a schematic view showing a conveyance part of the transfer medium before and after the fixing device. As shown in FIG. 4, the transfer medium, onto which a non-fixed toner image from the intermediate transfer belt 1 is transferred by the secondary transfer roller 5, enters the fixing nip along an entrance guide plate 51. The transfer medium being out from (exiting) the fixing nip is separated from the fixing belt 43 by the head end part 104. The separated transfer medium is conveyed along the separation plate 100 by the conveyance roller 3 so as to be discharged to a paper discharge tray (not shown).

Figure 5:
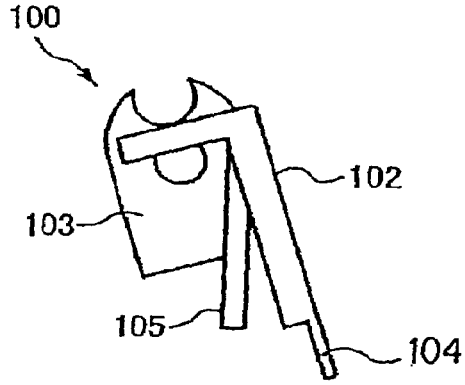
FIG. 5 is a cross-sectional view of a separation plate.
Figure 6:
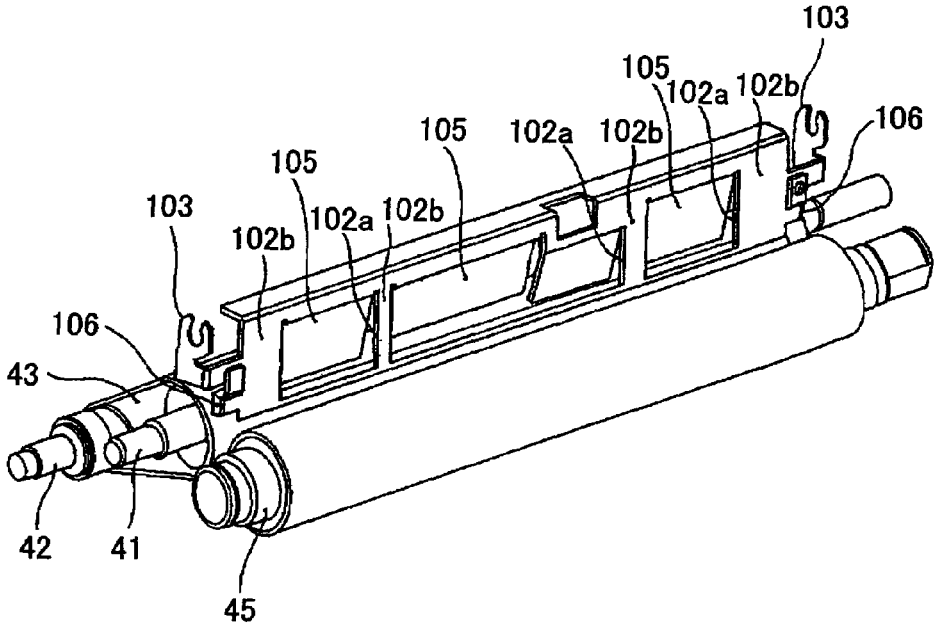
FIG. 6 is a perspective view showing a peripheral structure of the separation plate.

Next, the separation plate 100 is discussed with reference to FIG. 5 and FIG. 6. FIG. 5 is a cross-sectional view of the separation plate 100. FIG. 6 is a perspective view showing a peripheral structure of the separation plate 100. As shown in FIG. 5, the separation plate 100 includes a head end part 101 and a guide part 102. The head end part 104 has, as shown in FIG. 5, a structure where the thickness of the head end of the head end part 104 is equal to or less than 0.2 mm. While the head end of the head end part 104 has a small thickness in this embodiment, the thickness of the entire head end part 104 may be small. In a case where the thickness of the head end of the head end part 104 is equal to or less than 0.2 mm, the head end of the head end part 104 may be situated closer to the fixing nip. In a case where the thickness of the head end part 104 is equal to or less than 0.2 mm, it is possible to easily raise the temperature of the head end part 104 to such as 40° C. or higher at which temperature water vapor does not adhere to the head end part 101 due to heat of the transfer medium or radiation heat from the fixing belt 43. The head end part 104 may be formed such that the head end of the separation plate 100 has a thickness equal to or less than 0.2 mm or such that a separate plate having a thickness equal to or less than 0.2 mm is adhered.

The guide part 102 has a function whereby the transfer medium being out from the fixing nip is guided. A case installing part 103 is provided on both side surface of the guide part 102. These case installing parts 103 are attached to a case (not shown) of the fixing device. A positioning part 106 is provided at both ends of the guide part 102 so that the gap between the fixing belt 43 and the head end of the head end part 104 is securely maintained. The positioning part 106 is provided at the guide part 102 so as to come in contact with a transfer medium non-contact area of the fixing belt 43 so that the gap between the fixing belt 43 and the head end of the head end part 104 is securely maintained.

The guide part 102 has a heat conductivity limitation part. The heat conductivity limitation part has a structure where transfer of the heat of the head end part 104 to the guide part 102 is limited so that the temperature of the head end part 104 can easily rise. More specifically, as shown in FIG. 6, plural notch parts 102*a* provided in the guide part 102 and having rectangular configurations work as the heat conductivity limitation parts. That is, the heat transfer from the head end part 104 to the guide part 102 is limited by providing a large gap between the guide part 102 and the head end part 104 by the notch parts 102*a*.

The heat conductivity limitation part is not limited to the notch part. For example, the guide part and the head end part may be provided as separate members and the guide part and the head end part may be unified via a heat insulating material as the heat conductivity limitation part. Under this structure, the heat of the head end part is prevented from being transferred to the guide part by the heat insulating material. As a result of this, the temperature of the head end part can immediately rise to a temperature at which moisture condensation is not generated.

Figure 7:
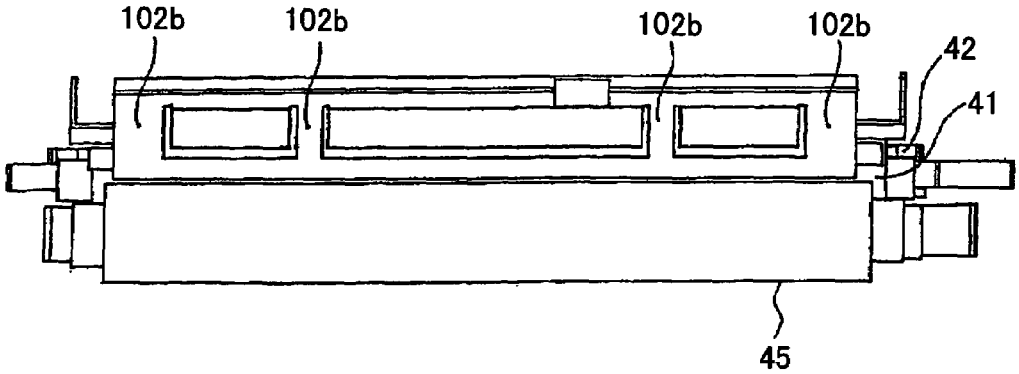
FIG. 7 is a view showing a relationship between the side of the transfer medium and an arrangement of a reinforcement part.

Plural reinforcing parts 102*b* for reinforcing the head end parts 101 are provided between notch parts 102*a*. The reinforcing parts 102*b* reinforces the head end part 104 so as to prevent the head end part 104 having a thin plate shaped configuration from being deformed. It is preferable that the reinforcing parts 102*b* face both ends of the transfer medium having a size which can be used for the printer. In the printer of this embodiment, as shown in FIG. 7, the reinforcing parts 102*b* are provided in four positions, namely positions facing both ends of the transfer medium having a minimum size which can be used for the printer and positions facing both ends of the transfer medium having a maximum size which can be used for the printer. In the printer of this embodiment, the center of the transfer medium passes through the center of the fixing belt 43. As shown in FIG. 7, the reinforcing parts 102*b* are provided symmetrically wherein the center of the fixing belt 43 is a center.

When the head end of the transfer medium is discharged from the transfer nip, the head end may be unstable, such as curled. Hence, the head end of the transfer medium does not always contact the head end part 104. The head end of the transfer medium may come in contact with the guide part situated above the head end part 104. However, even if the transfer medium comes in contact with the guide part, the head end of the transfer medium comes in contact with the reinforcing part 102*b* situated in a position facing both ends of the transfer medium having a minimum size which can be used for the printer. Hence, it is possible to separate the transfer medium from the fixing belt and to maintain the conveyance capability of the transfer medium.

It is preferable that the width in an axial direction of the reinforcing part 102*b* be set as corresponding to a position gap of the conveyed transfer medium. In a case of the printer of this embodiment, due to the configuration of the conveyance roller or the like and the position precision, the width in an axial direction of the reinforcing part 102*b* is set so that the position gap of the transfer medium of approximately ±3 mm can be accepted. Because of this, in the case of the printer in this embodiment, the width in an axial direction of the reinforcing part 102*b* is set to be equal to or greater than 6 mm.

In addition, since heat is transferred to the reinforcing part 102*b*, the temperature in the vicinity of the reinforcing part 102*b* of the head end part 104 is harder to make rise than the temperature of other parts. However, by providing the reinforcing part 102*b* in a position facing the end part of the transfer medium, it is possible to promote the rise of the temperature in the vicinity of the reinforcing part of the head end part 104. The reason of this is discussed below.

As discussed above, the temperature of the head end part 104 rises due to heat of the transfer medium and the radiation heat of the fixing belt 43. The temperature of a part of the head end part coming in contact with the transfer medium may rise due to the heat of the transfer medium easier than the temperature of a part not coming in contact with the transfer medium. On the other hand, the temperature of the part of the head end part not coming in contact with the transfer medium may rise due to the radiation head of the fixing belt 43 easier than the temperature of the part coming contact with the transfer medium. This is because heat of the part not coming in contact with the transfer medium of the fixing belt 43 is not caught by the transfer medium and therefore the temperature of the part not coming in contact with the transfer medium of the fixing belt 43 is higher than the part coming in contact with the transfer medium. Accordingly, the temperature of the part of the head end part not coming in contact with the transfer medium may rise due to the radiation heat of the fixing belt 43 easier than the temperature of the part coming in contact with the transfer medium.

The part facing the end part of the transfer medium of the head end part 104 receives influence of the rise of the temperature due to both radiation heat of a side whose temperature is higher of the fixing belt 43 and contact of the transfer medium. Hence, the temperature of the part facing the end part of the transfer medium of the head end part 104 may rise easer than other parts of the head end part 104. The reinforcing part 102*b* is provided in a position facing the end part of the transfer medium of the head end part 104 whose temperature easily rises so that it is possible to prevent the situation where the temperature in the vicinity of the reinforcing part of the head end part 104 is hard to rise due to removal of the heat by the reinforcing part 102*b*.

Figure 8:
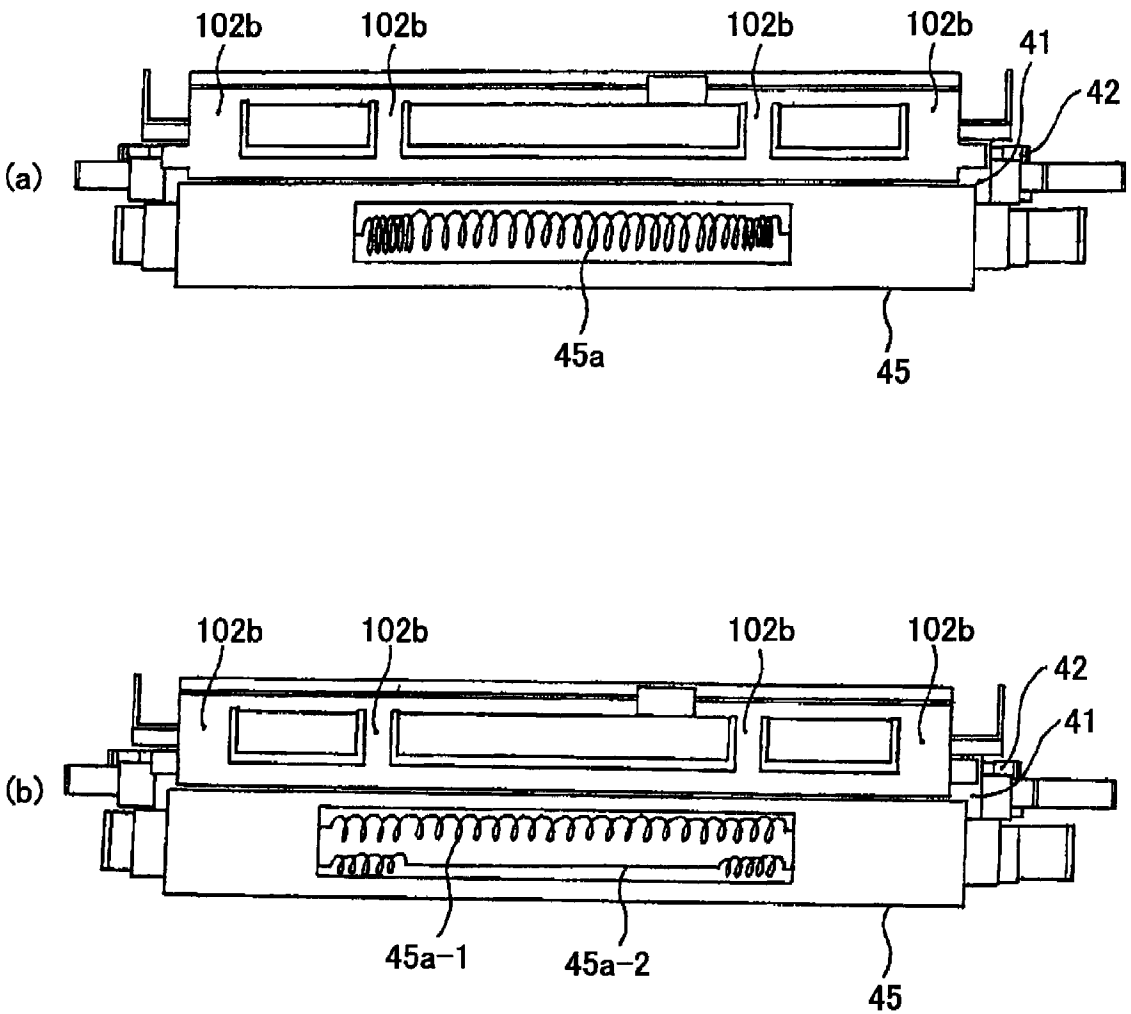
FIG. 8-(*a*) is a view showing an example wherein a quantity of heat generated from a heating part in a pressure roller is different in an axial direction, and FIG. 8-(*b*) is a view showing another example wherein the quantity of heat generated from the heating part in a pressure roller is different in the axial direction.

In addition, as shown in FIG. 8, heating values of the heat source 45*a* provided inside of the pressing roller 45 may vary depending on an axial direction so that the temperature of the part facing the reinforcing part 102*b* of the heating roller 45 is higher than a temperature of other part. For example, as is shown in FIG. 8-(*a*), a winding gap of a Nichrome wire in a position facing the reinforcing part 102*b* of the pressing roller 45 is made narrower than other part. Furthermore, as is shown in FIG. 8-(*b*), two heat sources 45*a* are provided. One heat source 45*a*-1 uniformly heats the entire pressing roller 45. The other heat source 45*a*-2 heats only a part facing the reinforcing part 102*b* of the pressing roller 45. Under this structure, the temperature of the part facing the reinforcing part 102*b* of the heating roller 45 is higher than the temperature of other part. As a result of this, the temperature in the vicinity of the reinforcing part of the head end part 104 rises more easily than the temperature of other parts due to the radiation heat of the pressing roller 45. Hence, even if the heat of the head end part 104 in the vicinity of the reinforcing part is removed by the reinforcing part, heat can be compensated for the radiation heat of the pressing roller whose temperature is higher than other parts. As a result of this, it is possible to prevent the difficulty in raising the temperature in the vicinity of a connection part of the head end part 104. Furthermore, while heating values of the heat source 45*a* provided inside of the pressing roller 45 vary depending on the axial direction in an example shown in FIG. 8, the present invention is not limited to this. For example, in order to make the temperature of the part facing the reinforcing part 102*b* of the fixing belt 43 higher than the temperature of other parts, the heating value generated from the heat source 44 provided inside of the heating roller 42 may vary depending on the axial direction.

In addition, as shown in FIG. 5, a water vapor receiving part 105 is provided in the guide part 102 of the separation plate 100. The water vapor receiving part 105 is inclined to a side of the fixing roller 46 against a virtual line connecting the guide part 102 and the head end part 104. By inclining the water vapor receiving part 105 to the side of the fixing roller, it is possible to provide the water vapor receiving part 105 at a designated distance apart from the transfer medium guide surface of the separation plate 104. Because of this, it is possible to prevent the water vapor adhering to the water vapor receiving part 105 from being adhered to the transfer medium. In addition, by inclining the water vapor receiving part 105 to the side of the fixing roller, it is possible to prevent a bad influence on the image due to adhesion of the water vapor generated from the transfer medium to the photosensitive body, the lens of a light exposure device, or the like. Furthermore, by inclining the water vapor receiving part 105 to the side of the fixing roller, a head end part of the water vapor receiving part 105 is arranged at a side further away from the transfer medium guide surface than is the head end part 104. Under this structure, it is possible to prevent water vapor condensed at the water vapor receiving part 105 from changing to water drop so as to be dropped onto the head end part 104. In a case where the water vapor of the transfer medium is adhered to the reinforcing part, the water vapor of the transfer medium is not increased because of the size of an area of the reinforcing part so that condensation can be prevented.

Figure 9:
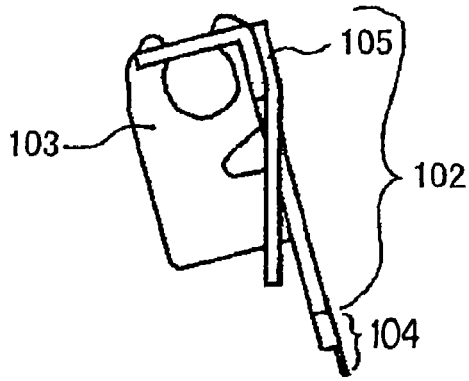
FIG. 9-(*a*) is a cross-sectional view of a separation plate having a structure where a water vapor receiving part is formed by another member, and FIG. 9-(*b*) is a perspective view showing a peripheral structure of the separation plate having the structure where the water vapor receiving part is formed by another member.
Figure 9:
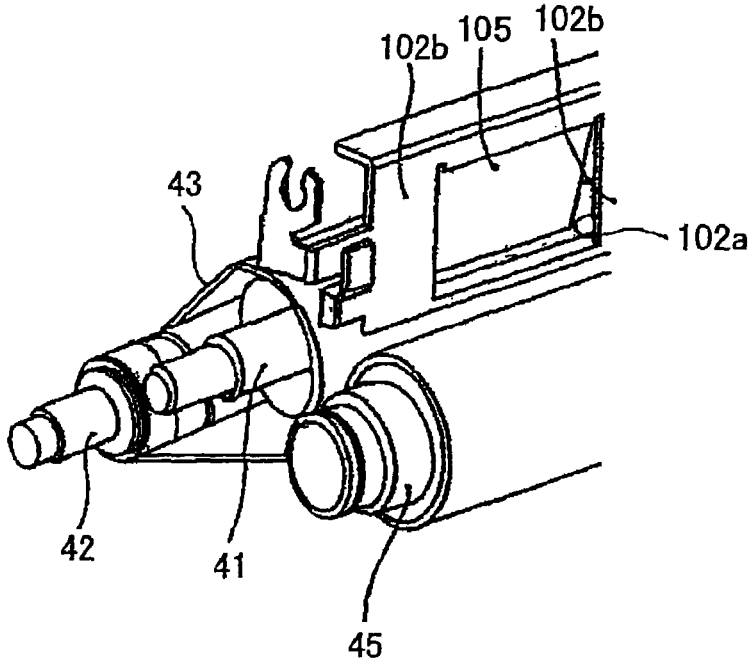

The water vapor receiving part 105 shown in FIG. 5 is made of the same metal as the guide part 102 in a body with the guide part 102. However, the present invention is not limited to this. The water vapor receiving part 105 may be provided separately from the guide part 102 as shown in FIG. 9. In addition, the water vapor receiving part 105 shown in FIG. 9 is made of resin having a lower conductivity than the head end part 104. Because of this, rise of the temperature of the water vapor receiving part 105 due to the heat inside of the fixing device is hard to be generated. Thus, water vapor from the transfer medium can be easily condensed onto the water vapor receiving part 105. Because of this, it is possible to gather more of the water vapor from the transfer medium, as compared to a water vapor receiving part made of a metal the same as the guide part 102.

Figure 10:
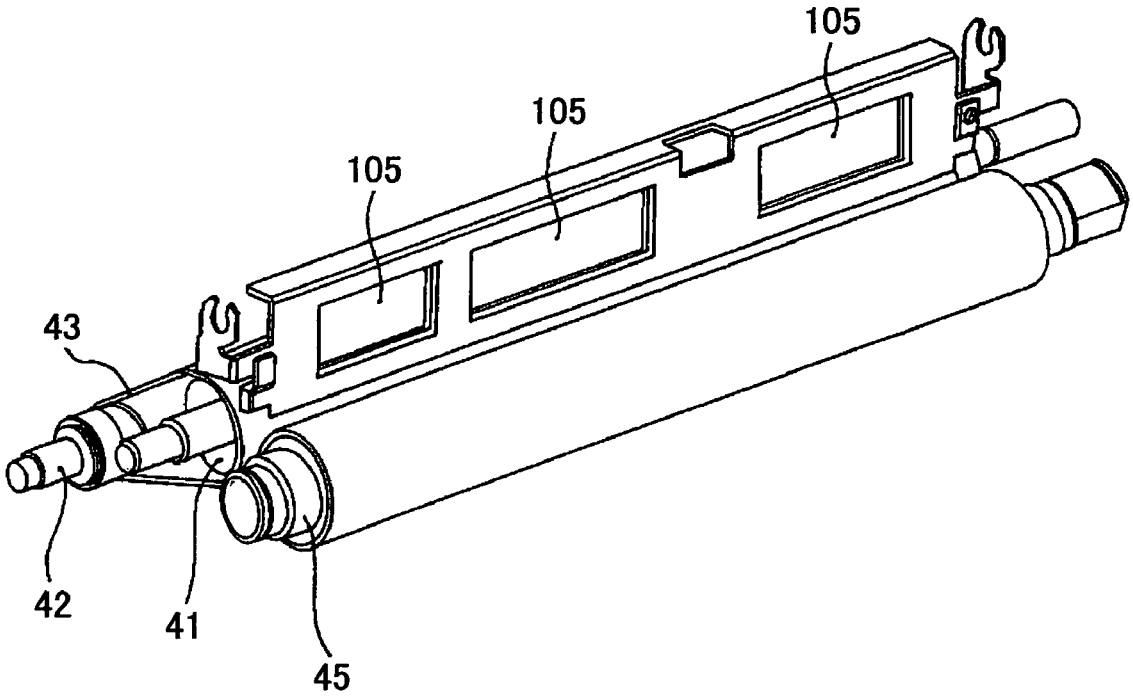
FIG. 10 is a view showing an example wherein the water vapor receiving part is formed by a drawing process.

Furthermore, as shown in FIG. 10, the water vapor receiving part 105 may be formed by a drawing process. In this case, the temperature of the head end part of the separation plate can easily rise more than the temperature of other parts by making the head end of the head end part thin so that the heat capacity is made small. The head end part and the guide part may be made separately and the head end part may be provided to the guide part via the heat insulating member so that the transfer of the heat of the head end part to the water vapor receiving part formed by the drawing process is prevented. As a result of this, the temperature of the head end part can rise well.

According to the embodiment discussed above, it is possible to provide a fixing device, including:

two surface moving bodies, at least one of which is driven so that the surface moving bodies come in contact with each other, a nip is formed, and surfaces of the surface moving bodies in contact move in the same direction; and a heat source configured to heat at least one of the surface moving bodies;

wherein a transfer medium having a surface where a non-fixed toner image is formed is put in the nip so that the toner image is heat-fixed on the transfer medium;

the fixing device further comprises a separation plate configured to remove the transfer medium, the transfer medium not being separated from the surface moving body after the transfer medium passes through the nip, from the surface moving body; and rise of temperature of a head end part, at a side of the surface moving body, of the separation plate is given priority over rise of temperature of other parts of the separation plate.

According to this fixing device, it is possible to immediately raise the temperature of the head end part to a temperature at which condensation is not generated by the transfer medium heated at a high temperature. Hence, it is possible to prevent a paper jam.

The separation plate may have a structure where a heat capacity of the head end part, at the surface moving body side, of the separation plate is lower than a heat capacity of other parts of the separation plate.

According to the above-mentioned fixing device, the temperature of the head end part of the separation plate can rise more quickly than the temperature of other parts of the separation plate.

The separation plate may include a heat conductivity limitation part configured to limit a transfer of the heat at the surface moving body side of the separation plate to other parts of the separation plate.

If the heat capacity of the head end part is low and the temperature of the head end part rises more immediately than other parts of the separation plate so that the temperature of the head end part is higher than the temperature of other parts of the separation plate, heat transfer wherein the heat of the head end part moves to other parts of the separation plate is generated. However, according to the above-mentioned fixing device, the separation plate includes the heat conductivity limitation part configured to limit the transfer of the heat at the surface moving body side of the separation plate to other parts of the separation plate. As a result of this, even if the temperature of the head end part is higher than the temperature of other parts of the separation plate, the heat of the head end part is not transferred to other parts of the separation plate. Hence, it is possible to immediately raise the temperature of the head end part to a temperature at which condensation is not generated.

The separation plate may include a reinforcing part configured to reinforce the head end part at the surface moving body; and the reinforcing part may face a part of the surface moving body, the part having a temperature higher than a surface average temperature in an axial direction of the surface moving body, in a position facing the head end part at the side of the surface moving body of the separation plate.

The heat of the head end part moves to this reinforcing part. Hence, as compared to a part where the reinforcing part is not provided, the speed of rise of the temperature to a temperature at which the condensation is not generated at the part where the reinforcing part is provided is slow. As a result, the condensation may be generated at the part where the reinforcing part of the head end part is provided. However, according to the above-discussed structure, as compared to a part where the reinforcing part is not provided, the amount of the radiation heat at the part where the reinforcing part is provided received from the surface moving body can be made large. As a result of this, at the part where the reinforcing part is provided, heat absorbed by the reinforcing part can be compensated for by the radiation heat from the surface moving body. Therefore, as compared to a part where the reinforcing part is not provided, the speed of rise of the temperature to a temperature at which the condensation is not generated at the part where the reinforcing part is provided is fast. Thus, it is possible to prevent the condensation from being generated at the part where the reinforcing part of the head end part is provided.

Heating values of the heat source in an axial direction may vary so that the temperature of the part of the surface moving body facing the reinforcing part is higher than a surface average temperature in the axial direction of the surface moving body.

According to the above-mentioned fixing device, the temperature of the part of the surface moving body facing the reinforcing part can be greater than a surface average temperature in the axial direction of the surface moving body.

The reinforcing part may be provided in a position facing an end part of a conveyed transfer medium.

The temperature of the part coming in contact with the transfer medium at the head end part easily rises due to heat of the transfer medium as compared to a part not coming in contact with the transfer medium. On the other hand, the temperature of the part facing the transfer medium rises due to the radiation heat of the surface moving body easier than the part facing the transfer medium at the head end part. This is because heat of the part not coming in contact with the transfer medium of the surface moving body is not caught by the transfer medium and therefore the temperature of the part not coming contact with the transfer medium is greater than the temperature of the part coming in contact with the transfer medium. Accordingly, the temperature of the part not facing the transfer medium may rise due to the radiation head of the surface moving body easier than the part facing the end part of the transfer medium of the head end part. Because of this, the part facing the end part of the transfer medium of the head end part receives influence of the rise of the temperature due to both radiation heat of a side whose surface temperature is higher and contact of the transfer medium. By providing the reinforcing part in the position facing the end part of the conveyed transfer medium, the heat absorbed by the reinforcing part can be compensated for by the radiation heat whose surface temperature is higher and the heat of the transfer medium. Therefore, as compared to a part where the reinforcing part is not provided, the speed of rise of the temperature to a temperature at which the condensation is not generated at the part where the reinforcing part is provided is fast.

The separation plate may include a water vapor receiving part configured to receive a water vapor generated from a transfer medium; and the water vapor receiving part may be provided in a position where water being condensed at the water vapor receiving part does not drop onto the head end part at the side of the surface moving body.

According to the above-mentioned fixing device, by providing the water vapor receiving part and making the water vapor generated from the transfer medium condense at the water vapor receiving part, the water vapor generated from the transfer medium can be prevented from condensing at the guide member provided at a discharge path or onto a photosensitive body. In addition, by providing the water vapor receiving part in a position where water being condensed at the water vapor receiving part does not drop to the head end part, it is possible to prevent the water from dropping onto the head end part. Hence, it is possible to prevent a paper jam from being generated because of the adhesion of the transfer medium to the head end part due to water adhering to the head end part from being generated.

The water vapor receiving part may be provided in a position separated from the head end part at the surface moving body away from a conveyance surface of the transfer medium.

According to the above-mentioned fixing device, it is possible to prevent the contact of the transfer medium with the water vapor receiving part. Hence, it is possible to prevent the transfer medium from being stained due to condensation adhered to the water vapor receiving part and a paper jam from being generated due to adhesion of the transfer medium to the water vapor receiving part.

The water vapor receiving part may be made of a material having a low heat conductivity.

According to the above-mentioned fixing device, the rise of the temperature at the water receiving part is difficult and therefore the temperature of the water vapor receiving part can be maintained at the temperature at which the water vapor generated from the transfer medium is condensed. Because of this, the condensation of the water vapor generated from the transfer medium at the photosensitive body can be prevented.

According to the embodiment discussed above, it is also possible to provide an image forming apparatus, including:

a toner image forming part configured to form a toner image on a transfer medium; and a fixing part configured to fix the toner image to the transfer medium;

wherein the fixing part comprising:

two surface moving bodies, at least one of which is driven so that the surface moving bodies come in contact with each other, a nip is formed, and surfaces of the surface moving bodies in contact move in the same direction; and a heat source configured to heat at least one of the surface moving bodies;

wherein a transfer medium having a surface where a non-fixed toner image is formed is put in the nip so that the toner image is heat-fixed on the transfer medium;

the fixing device further comprises a separation plate configured to remove the transfer medium, the transfer medium not being separated from the surface moving body after the transfer medium passes through the nip, from the surface moving body; and rise of temperature of a head end part, at a side of the surface moving body, of the separation plate is given priority over rise of temperature of other parts of the separation plate.

According to the above-mentioned image forming apparatus, it is possible to prevent paper jams.

The present invention is not limited to the above-discussed embodiments, but variations and modifications may be made without departing from the scope of the present invention.

This patent application is based on Japanese Priority Patent Application No. 2004-347677 filed on Nov. 30, 2004, the entire contents of which are hereby incorporated by reference.

The invention claimed is:

1. A fixing device configured to fix a toner image on a transfer medium, comprising:

a separation plate configured to remove the transfer medium from a surface moving body, the separation plate including:

a guide part configured to guide the transfer medium; and a head end part, wherein a plurality of notch parts are provided in the guide part; and wherein one of the notch parts in a center part of the guide part has a width greater than a width of one of the notch parts in an end part of the guide part.

2. The fixing device claimed in claim 1, wherein the head end part is thinner than the guide part.

3. The fixing device as claimed in claim 1, wherein the surface moving body is a fixing belt.

4. A fixing device configured to fix a toner image on a transfer medium, comprising:

a separation plate configured to remove the transfer medium from a surface moving body, the separation plate including:

a guide part configured to guide the transfer medium; and a head end part, wherein a notch part is provided in the guide part; and a vapor receiving part is provided inside the notch part.

5. The fixing device as claimed in claim 4, wherein the vapor receiving part inclines to a side of the surface moving body.

6. The fixing device as claimed in claim 4, wherein the vapor receiving part is made of a material having a thermal conductivity lower than a thermal conductivity of the guide part.

7. A fixing device configured to fix a toner image on a transfer medium, comprising:

a separation plate configured to remove the transfer medium from a surface moving body, the separation plate including:

a guide part configured to guide the transfer medium: and a head end part provided in the guide part via a heat insulating material, wherein the head end part is thinner than the guide part.

8. An image forming apparatus, comprising:

a fixing device claimed in one of claims 1, 2 and 3 through 4.

9. A fixing device configured to fix a toner image on a transfer medium, comprising:

a separation plate configured to remove the transfer medium from a surface moving body, the separation plate including:

a guide part configured to guide the transfer medium; and a head end part, wherein a plurality of openings are provided in the guide part; and wherein one of the openings in a center part of the guide part has a width greater than a width of one of the openings in an end part of the guide plate.

* * * * *